United States Patent [19]

Brazelton et al.

[11] Patent Number: 4,688,945

[45] Date of Patent: Aug. 25, 1987

[54] MIXING APPARATUS

[75] Inventors: Carl L. Brazelton, Austin, Tex.; Troy C. Litherland, Bradley, Ill.

[73] Assignee: Stranco, Inc., Bradley, Ill.

[21] Appl. No.: 782,875

[22] Filed: Oct. 2, 1985

[51] Int. Cl.[4] ..... B01F 15/02

[52] U.S. Cl. ..... 366/156; 366/163; 366/165; 366/169; 366/178

[58] Field of Search ..... 366/76, 96–98, 366/156, 64, 163–165, 169, 65, 178, 177, 167, 168, 192, 193, 279

[56] References Cited

U.S. PATENT DOCUMENTS

| | | | |
|---|---|---|---|
| 1,982,479 | 11/1934 | Ober et al. | 366/178 X |
| 3,047,275 | 7/1962 | Cox . | |
| 3,207,485 | 9/1965 | Warren . | |
| 3,414,245 | 12/1968 | Frazer | 366/102 X |
| 3,697,052 | 10/1972 | Andris . | |
| 3,820,759 | 6/1974 | Hege . | |
| 3,871,627 | 3/1975 | Marshall . | |
| 4,077,612 | 3/1978 | Ricciardi | 366/165 X |
| 4,085,463 | 4/1978 | Wilson . | |
| 4,218,012 | 8/1980 | Hamza et al. . | |
| 4,249,828 | 2/1981 | Condolios | 366/169 X |
| 4,274,749 | 6/1981 | Lake et al. . | |
| 4,405,087 | 9/1983 | Mata-Garza . | |
| 4,426,156 | 1/1984 | Adamo et al. . | |
| 4,499,561 | 2/1985 | Mason et al. . | |

OTHER PUBLICATIONS

Bulletin 510, Acrison, Inc., 1985.
Brochure of Aquatron Incorporated.

*Primary Examiner*—Timothy F. Simone
*Attorney, Agent, or Firm*—Emrich & Dithmar

[57] ABSTRACT

Dry polymer is fed from a hopper into the funnel-shaped path of a mixing structure which has upper and lower nozzle portions cooperating to define a frusto-conical nozzle opening or eductor which provides communication between the path and a surrounding annular chamber. Water is delivered along the side of the chamber so that it swirls through the nozzle opening and is ejected into the funnel-shaped path in a conical swirling stream which mixes with dry powder falling along the path and forms a Venturi to draw the powder along the path. The swirling mixture is injected into the top of a vertical rotating tube which extends down into a container and carries an elongated hollow impeller at its lower end. The water polymer mixture is further mixed in the tube and sprayed through the impeller into an upper mixing compartment of the container. Liquid is drawn through openings in the bottom of the impeller to facilitate the mixing action. The mixture is then passed to a lower aging compartment, from which it is fed to auxiliary mixing and diluting means. Control means prevents feeding of the dry polymer in the absence of the conical water stream.

6 Claims, 11 Drawing Figures

FIG. 6
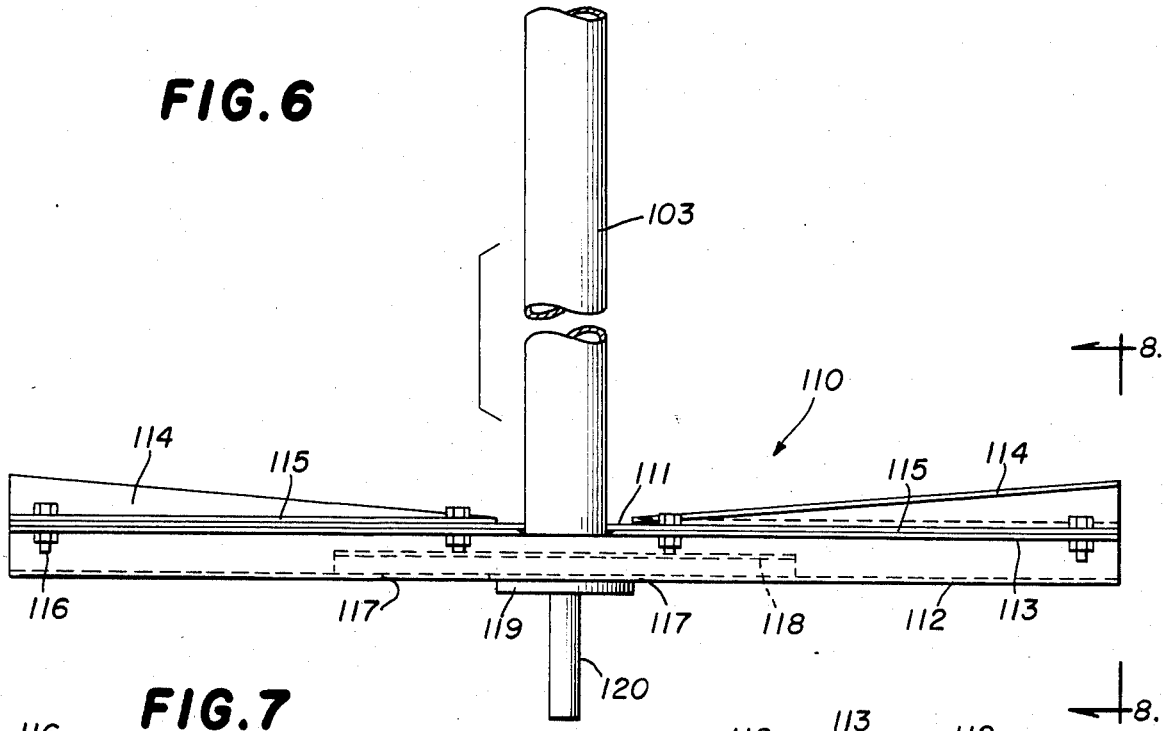
FIG. 7
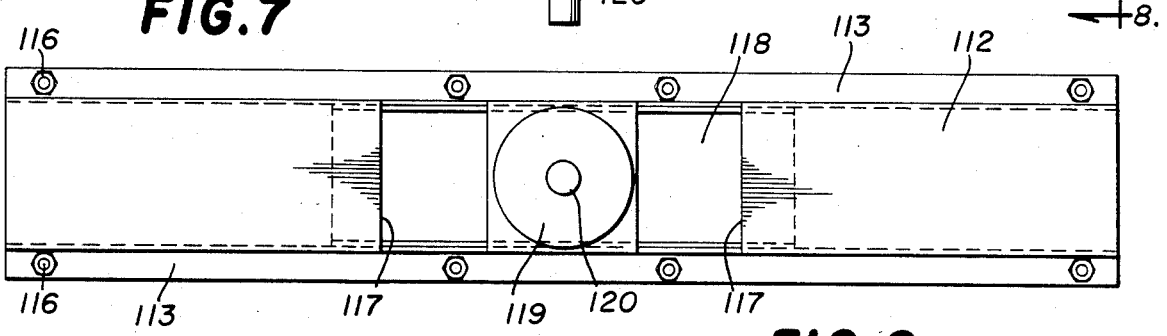
FIG. 9
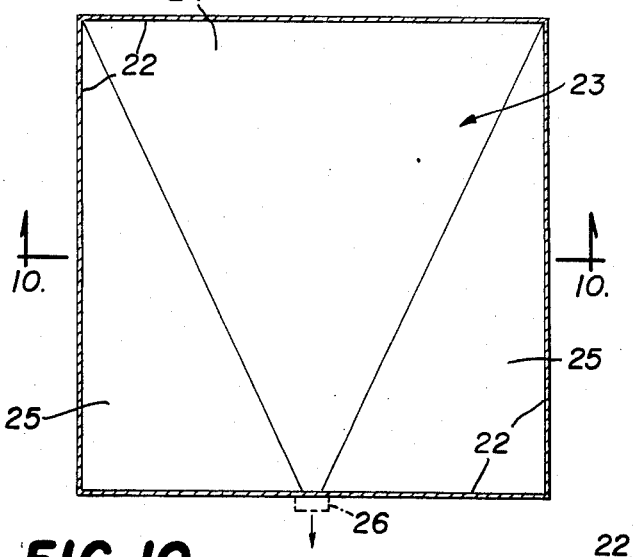
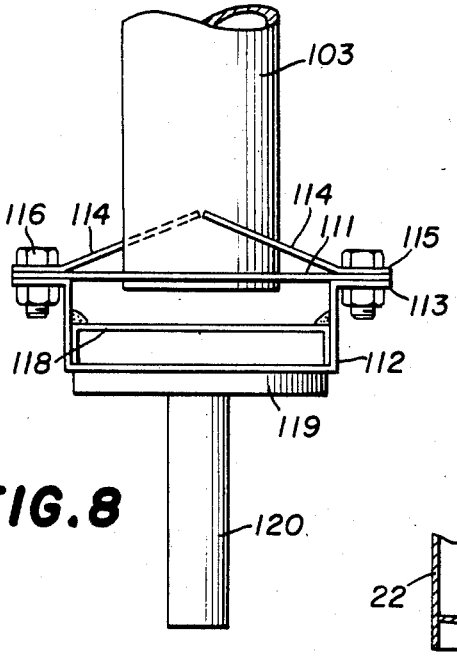
FIG. 8
FIG. 10
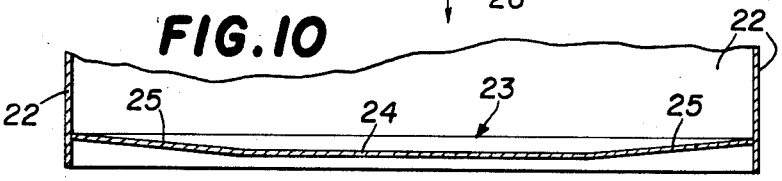

MIXING APPARATUS

BACKGROUND OF THE INVENTION

The present invention relates to apparatus for mixing a dry particulate material and a liquid diluent, and relates particularly to the mixing of dry particulate materials which are difficult to wet or disperse, are shear sensitive or tend to produce a viscous suspension. The invention has particular application to the preparation of mixtures of dry synthetic polyelectrolytes and water.

Polymers are commonly used in water treatment equipment in order to remove solids suspended in the water. Polymers or polyelectrolytes as they are sometimes called carry an electrostatic charge which attracts particles suspended in water. Since virtually all solids carry a negative or positive charge, they are attracted to these polymers. Polymers have extremely large molecules with millions of charge sites that attract suspended particles. Synthetic polymers are available in dry and liquid form. Dry polymer is desirable for many applications because it has low weight, which saves on shipping expenses; can be easily stored and shipped in plastic lined sacks, which are relatively inexpensive as compared with disposable metal drums which must be used for liquid polymer, and has indefinite shelf life, whereas with liquid polymers the more dilute the mixture the shorter the shelf life. Furthermore, dry polymers have been approved as safe and effective in certain food grade and potable applications, whereas many liquid products have not received such approval.

However, dry polymer must be mixed with water before it can be used. The dry polymer is hygroscopic and its suspensions in water are thixotropic. In other words, the dry polymers do not readily mix with water. Most existing systems for mixing dry polymer and water rely on two steps, viz., (1) a wetting/dispersing step wherein the dry polymer is initially contacted by and mixed with the water, and (2) a mixing/aging step wherein the mixture is further mixed and stored in a holding tank.

The first step is generally accomplished by some type of eductor or vortex device to impart a high energy into the dry material and to get the individual particles thereof separated and dispersed as quickly as possible to prevent them from agglomerating into clumps, fisheyes, stringers, snowflakes, and the like which, once formed, are difficult to eliminate.

Nevertheless, many of the existing mixing systems are subject to agglomeration of dry polymer particles during the wetting/dispersing step. Furthermore, the dry polymer is typically introduced into the eductor through a straight tube which frequently is bridged by dry polymer, further aggravating the agglomeration condition. Additionally, unwetted particles which leave the eductor frequently become stuck along the inlet pipe to the holding tank, causing clogging at that location. Many of these systems also rely on the introduction of air in in the wetting/dispersing step to facilitate separation of the particles of dry polymer. But this reduces the volume of water which is available in the wetting/dispersing stage of the process.

The second step is generally accomplished in a holding tank equipped with a propeller type mixer. The wetted and dispersed polymer/water mixture is introduced into the tank through a pipe at a fixed location, the stationary propeller being used to accomplish distribution and agitation of the incoming material as the level in the tank rises. In many of these prior systems additional water is fed directly to the holding tank for further dilution of the mixture.

But this arrangement does not achieve an even distribution of the mixture in the holding tank, and the mixing energy imparted by the impeller can vary depending upon the level of mixture within the holding tank. Furthermore, the introduction of additional diluent into the holding tank means that that additional diluent is not available for use in the initial wetting and mixing step.

Furthermore, in prior mixing devices severe agglomeration problems can result in the event of a stoppage of the water supply in the initial mixing and wetting step, since the feeding of dry polymer may continue for a short time until the feed mechanism can shut down.

SUMMARY OF THE INVENTION

It is a general object of the present invention to provide a mixing system for mixing dry particulate material and a liquid diluent, which avoids the disadvantages of prior mixing systems while affording additional structural and operating advantages.

An important object of the invention is the provision of a mixing apparatus of the type set forth, which is of relatively simple and economical construction.

Yet another object of the invention is the provision of a mixing apparatus of the type set forth, which effectively prevents agglomeration of dry particulate material.

In connection with the foregoing objects, it is another object of the invention to provide a mixing apparatus of the type set forth, which introduces all of the liquid diluent in an initial wetting/dispersing stage.

Still another object of the invention is the provision of a mixing apparatus of the type set forth, which utilizes a Venturi effect to facilitate drawing of the dry particulate material through the device.

Another object of the invention is the provision of a mixing apparatus of the type set forth which utilizes two types of mixing before introduction into the holding tank.

Still another object of the invention is the provision of a mixing apparatus of the type set forth, which introduces the mixture of particulate material and liquid diluent into the holding tank along a variable path.

Still another object of the invention is the provision of means for preventing introduction of dry particulate material to the apparatus in the absence of liquid diluent.

Certain ones of these and other objects of the invention are attained by providing apparatus for mixing dry particulate material and a liquid diluent, the apparatus comprising: conduit means defining a path for particulate material and having a frustoconical portion disposed in a mixing region of the path and converging toward an exit end of the conduit means, means for feeding particulate material into the conduit means, nozzle means coupled to an associated source of liquid diluent for establishing a hollow, swirling, frustoconical stream of liquid diluent and introducing the stream into the mixing region of the path so that the stream converges toward the exit end of the conduit means, the stream of liquid diluent wetting and mixing with the particulate material in the mixing region and cooperating with the frustoconical portion to form a Venturi for drawing particulate material into the mixing region along the path, and container means for receiving a mixture of particulate material and liquid diluent from the conduit means.

Others of the objects of the invention are attained by providing apparatus for mixing dry particulate material and a liquid diluent, the apparatus comprising: means for establishing a hollow, swirling, frustoconical stream of liquid diluent, means for establishing a flow of dry particulate material axially through the stream for mixing therewith and forming a swirling stream of the mixture, an elongated tube having a longitudinal axis and disposed for receiving the swirling stream of the mixture into one end thereof, means for rotating the tube about its axis, discharge means connected to the other end of the tube for rotation therewith and defining a discharge channel communicating with the interior of the tube and extending laterally outwardly therefrom, and a container receiving the other end of the tube, whereby rotation of the tube effects further mixing of the particulate material and the liquid diluent therein and centrifugal spraying of the mixture into the container through the discharge means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 6 is an enlarged, fragmentary, side elevational view of the impeller mixing assembly in the lower portion of FIG. 1;

FIG. 7 is a bottom plan view of the impeller mixing assembly illustrated in FIG. 6;

FIG. 8 is an enlarged, fragmentary, end elevational view taken generally along the line 8—8 in FIG. 6;

FIG. 9 is a reduced view in horizontal section taken along the line 9—9 in FIG. 1, and rotated 90° clockwise;

FIG. 10 is an enlarged, fragmentary view in vertical section taken along the line 10—10 in FIG. 9.

DESCRIPTION OF THE PREFERRED EMBODIMENT

Figure 1:
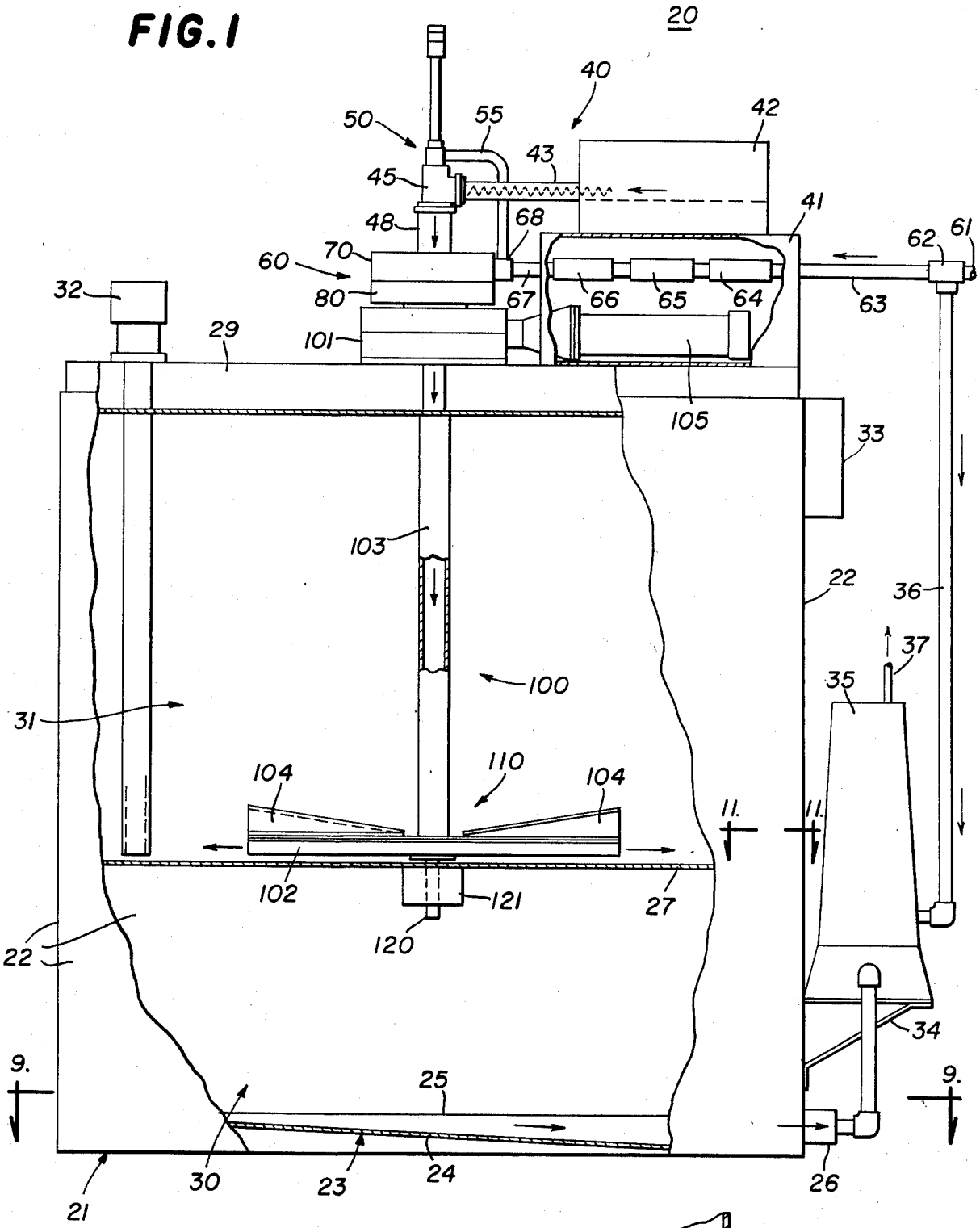
FIG. 1 is a side elevational view of the mixing apparatus of the present invention, with portions broken away more clearly to show the internal construction thereof.
Figure 11:
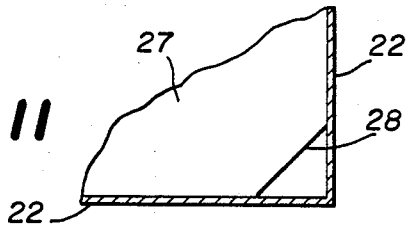
FIG. 11 is a fragmentary view in horizontal section taken along the line 11—11 in FIG. 1.

Referring to FIG. 1, there is illustrated a mixing apparatus, generally designated by the numeral 20, constructed in accordance with and embodying the features of the present invention. The mixing apparatus 20 includes a large, rectangular, box-like housing 21 having four vertical rectangular side walls 22, closed at the lower end thereof by a bottom wall 23 which forms a trough. More particularly, referring also to FIGS. 9 and 10, the bottom wall 23 includes a generally triangular sloping center section 24 and a pair of triangular sloping side sections 25, the side sections 25 sloping downwardly toward the center section 24 and the center section 24 sloping downwardly toward an outlet 26. Spaced above the bottom wall 23 is a generally rectangular baffle plate 27 which is disposed horizontally and mounted in the housing 21 by suitable means (not shown). The four corners of the baffle plate 27 are truncated (see FIG. 11), to provide four triangular openings 28. Mounted at the top of the housing 21 and spanning two opposite ones of the side walls 22 is a mounting bracket or bridge 29 which is generally hat-shaped in transverse cross section.

The corner openings 28 in the baffle plate 27 provide communication between an aging compartment 30 disposed beneath the baffle plate 27 and a mixing compartment 31 above the baffle plate 27. Carried by the bridge 29 and extending downwardly into the mixing compartment 31 is a level sensor 32 for detecting and responding to the level of fluid contained in the mixing compartment 31. Mounted on one of the side walls 22 adjacent to the upper end thereof is an electrical control box 33 containing control circuitry for the mixing apparatus 20. Secured to the same side wall 22 adjacent to the lower end thereof is a bracket 34 on which is mounted an auxiliary mixer and diluter 35, which may be of the type disclosed in U.S. Pat. No. 4,522,502, the disclosure of which is incorporated herein by reference. Water is supplied to the mixer and diluter 35 through a water inlet pipe 36, the diluted mixture from the mixer and diluter 35 being fed through an outlet conduit 37.

Figure 2:
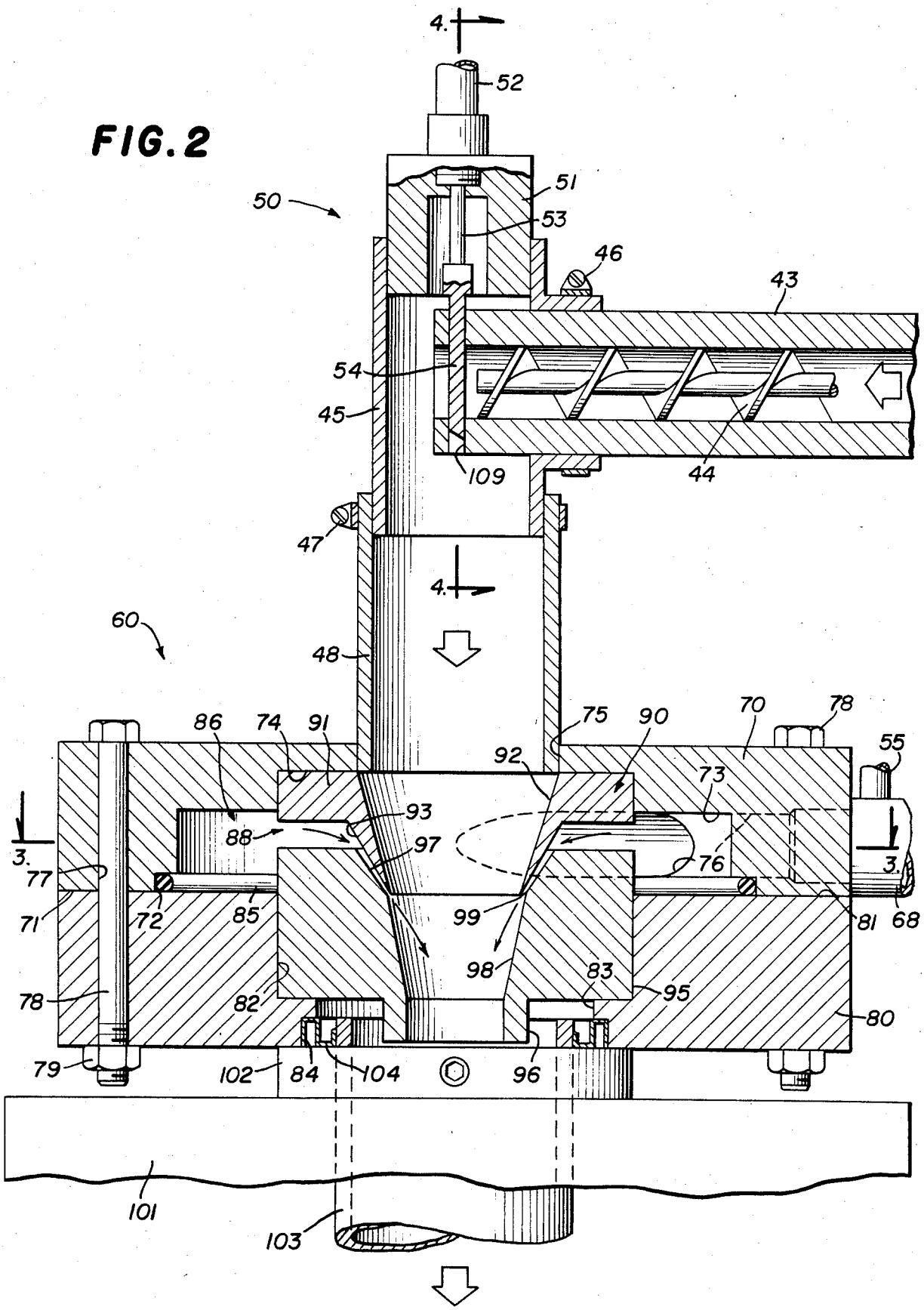
FIG. 2 is an enlarged, fragmentary view in vertical section through the upper portion of the mixing apparatus of FIG. 1.
Figure 4:
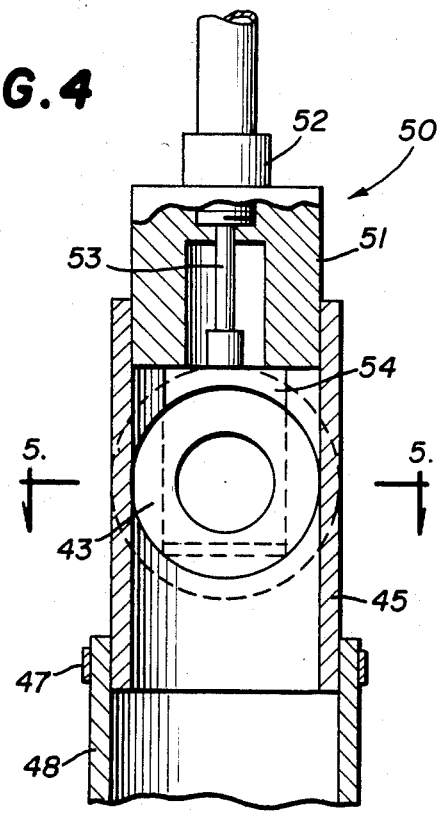
FIG. 4 is a fragmentary view in vertical section taken along the line 4—4 in FIG. 2.
Figure 5:
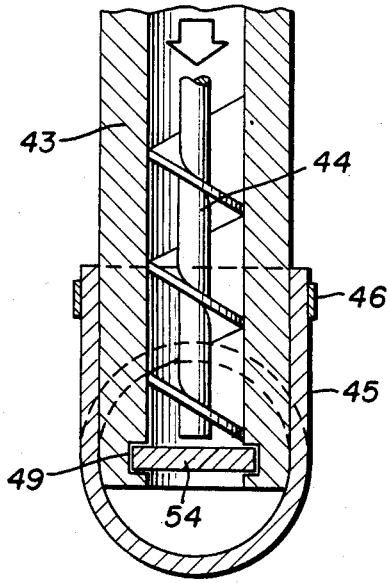
FIG. 5 is a fragmentary view in horizontal section taken along the line 5—5 in FIG. 4.

Referring also to FIGS. 2, 4 and 5, there is mounted on the bridge 29 a dry polymer feed assembly 40, which includes a hollow support frame 41 carried by the bridge 29. Mounted on the support frame 41 is a dry polymer hopper 42 from which dry polymer is fed horizontally through a feed conduit 43 by a feed auger 44. The exit end of the feed conduit 43 is received within the horizontal leg of of a tee pipe 45, and extends into the vertical leg thereof (see FIG. 2), being secured in place by a clamp 46. The lower end of the vertical leg of the tee pipe 45 is received within the upper end of a vertical inlet conduit 48, being secured thereto by a clamp 47. The feed conduit 43 has a rectangular slot 49 extending vertically therethrough adjacent to the exit end thereof.

The feeding of dry polymer from the feed conduit 43 is controlled by a feed control gate assembly 50, which includes a bushing 51 fitted into the upper end of the vertical leg of the tee pipe 45. Threadedly secured in the bushing 51 is the lower end of a fluid-actuated cylinder 52 having a vertically reciprocating piston rod 53 which extends downwardly through the bushing 51 and is fixedly secured at its lower end to a rectangular gate 54, which is received in the slot 49 in the feed conduit 43. The gate 54 is normally spring-biased to a closed position, illustrated in FIGS. 2, 4 and 5, for closing the exit end of the feed conduit 43 and preventing the feeding of dry polymer therefrom. When pressurized fluid is applied to the air cylinder 52, the gate 54 is retracted against the urging of the bias spring to a raised or open position, opening the exit end of the feed conduit 43 and permitting the feeding of dry polymer therefrom. Preferably, the drive fluid for the cylinder 52 is water which is supplied through a water hose 55 (see FIG. 1).

The lower end of the inlet conduit 48 is received in an eductor mixer assembly 60, wherein dry polymer is initially wetted by and mixed with water. Water is supplied from a water inlet 61 through a tee coupling 62, one leg of which is coupled to the water inlet pipe 36 for the mixer and diluter 35. The other leg of the tee coupling 62 is coupled to a conduit 63 which is, in turn, coupled through a solenoid valve 64, a flow control valve 65 and a pressure switch 66 to a conduit 67 which is coupled to the horizontal leg of a tee coupling 68, the vertical leg of which is coupled to the water hose 55.

The solenoid valve 64 starts and stops the flow of water to the eductor mixer assembly 60, and is preferably coupled to the level sensor 32 for controlling the operation of the eductor mixer assembly 60 in response to the level of fluid in the mixing compartment 31. The flow control valve 65 insures constant water flow despite fluctuation in source pressure. The pressure switch 66 operates to close the solenoid valve 64 in the event of loss of water pressure. Because the water hose 55 is connected to the tee coupling 68, it will be appreciated that water will be supplied to the feed control gate assembly 50 only when it is supplied to the eductor mixer assembly 60. Thus, the gate 54 can be opened to permit the feeding of dry polymer only when water is being supplied to the eductor mixer assembly 60, thereby preventing the feeding of dry polymer when there is no diluting water being supplied.

The tee coupling 68 is threadedly coupled to an upper plate 70 of the eductor mixer assembly 60. The upper plate 70 has a flat, planar, lower face 71 disposed horizontally in use, and having a circular counterbore 72 formed therein centrally thereof. Formed in the counterbore 72 is a reduced-diameter circular cavity 73, in which is formed a further reduced-diameter circular recess 74. A circular bore 75 extends through the top of the upper plate 70 and communicates with the circular recess 74 and receives therein the lower end of the inlet conduit 48, as can best be seen in FIG. 2. The tee coupling 68 communicates with a water inlet channel 76 which extends laterally through the upper plate 70 and into the circular cavity 73 substantially tangentially thereof (see FIGS. 2 and 3).

Bolt holes 77 extend vertically through the upper plate 70 and receive therein bolts 78 which cooperate with nuts 79 for fixedly securing the upper plate 70 to a lower plate 80, which has a flat planar upper face 81 disposed in use against the lower face 71 of the upper plate 70. Formed in the upper face 81 is a circular recess 82 communicating at the bottom thereof with a reduced-diameter circular bore 83 which extends through the lower plate 80. The bottom face of the lower plate 80 is provided with a circular counterbore 84 around the bore 83. In use, an O-ring seal 85 is seated in the counterbore 72 for providing a fluid-tight seal between the upper and lower plates 70 and 80. It will be appreciated that when the upper and lower plates 70 and 80 are connected together in their assembled condition illustrated in FIG. 2, the upper face 81 of the lower plate 80 cooperates with the circular cavity 73 in the upper plate 70 to define an annular chamber 86 which surrounds a nozzle assembly 88.

Figure 3:
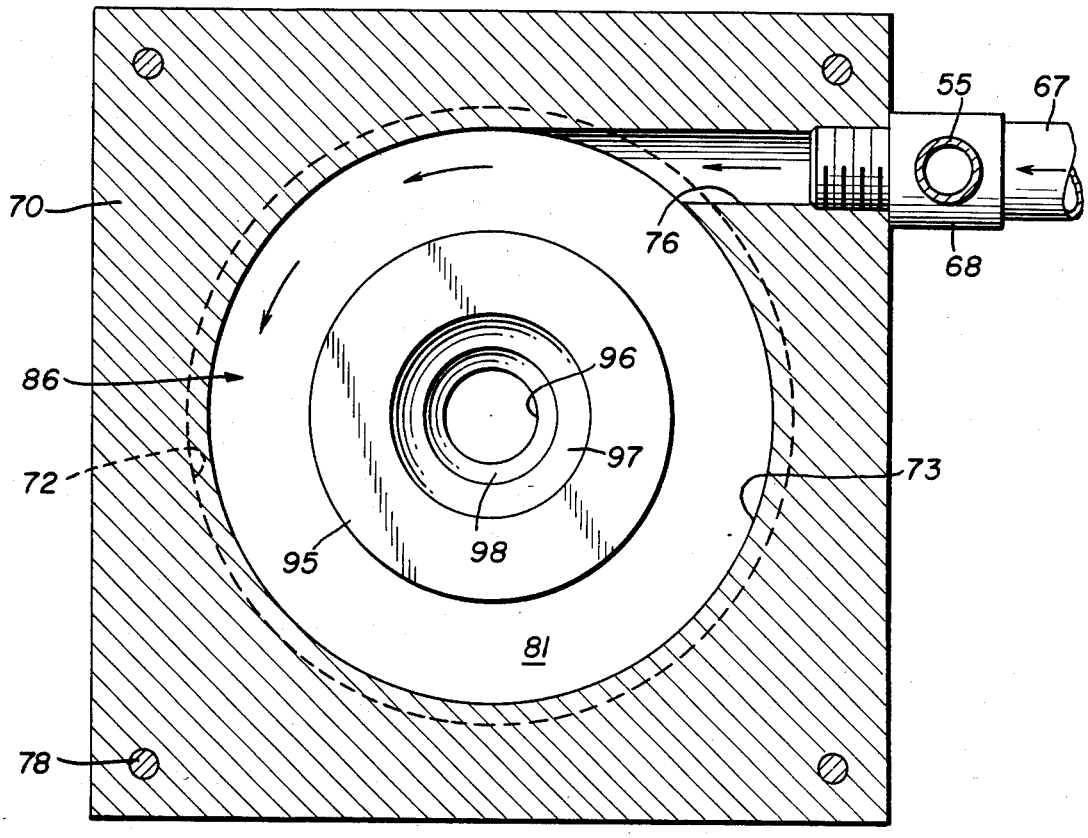
FIG. 3 is a view in horizontal section taken along the line 3—3 in FIG. 2.

More particularly, referring to FIGS. 2 and 3, the nozzle assembly 88 includes an upper nozzle insert 90 which has an annular flange 91 frictionally fitted in the circular recess 74 of the upper plate 70. The nozzle insert 90 has a frustoconical inner surface 92 and a frustoconical outer surface 93, both converging downwardly and intersecting at the exit end of the upper nozzle insert 90. There is also provided a lower nozzle insert 95 which is frictionally fitted in the recess 82 in the lower plate 80, and is provided with a hollow cylindrical outlet neck 96 which extends coaxially through the bore 83. The lower nozzle insert 95 has an upper frustoconical inner surface 97 which converges downwardly and is continuous at its lower end with a lower frustoconical inner surface 98, which also converges downwardly and communicates with the outlet neck 96.

When the parts are disposed in their assembled condition illustrated in FIG. 2, the exit end of the upper nozzle insert 90 is received into the upper frustoconical inner surface 97 of the lower nozzle insert 95, terminating substantially at the junction between the upper and lower frustoconical inner surfaces 97 and 98. Thus, it will be seen that the inlet conduit 48 and the upper and lower nozzle inserts 90 and 95 cooperate to define a vertical path for dry polymer through the eductor mixer assembly 60, this path having a funnel-shaped portion defined by the frustoconical inner surfaces 92 and 98. The upper frustoconical inner surface 97 is spaced from the frustoconical outer surface 93 for cooperation therewith to define an annular nozzle opening 99 providing communication between the annular chamber 86 and the vertical path through the nozzle assembly 88. As will be explained in greater detail below, the nozzle opening 99 accommodates the injection of water into a mixing region of the vertical polymer path defined by the lower frustoconical inner surface 98 and the outlet neck 96.

The outlet neck 96 of the nozzle assembly 88 communicates with the upper end of a rotating tube mixing assembly 100. Referring in particular to FIGS. 1 and 2, the rotating tube mixing assembly 100 includes a gear reducer and drive assembly 101 which is mounted on the bridge 29 and has a coupling collar 102 which is secured to the bottom of the lower plate 80 of the eductor mixer assembly 60. An elongated vertical mixing tube 103 has the upper end thereof received through the gear reducer and drive assembly 101 and into the bore 83 of lower plate 80 of the eductor mixer assembly 60, in surrounding relationship with the outlet neck 96. A seal 104 is seated in the counterbore 84 of the lower plate 80 for providing a fluid-tight seal between the lower plate 80 and the mixing tube 103.

The gear reducer and drive assembly 101 is fixedly secured by suitable means (not shown) to the mixing tube 103 and is also coupled to a drive motor 105 which is disposed within the support frame 41. Operation of the drive motor 105 effects a rotation of the mixing tube 103 about its vertical axis in a known manner. The mixing tube 103 extends downwardly into the mixing compartment 31 to a point just above the baffle plate 27 and is there secured to an impeller mixer assembly 110.

Referring also to FIGS. 6–8, the impeller mixer assembly 110 includes an elongated rectangular main plate 111 which receives the lower end of the mixing tube 103 through a complementary opening therein centrally thereof and is fixedly secured thereto, by welding. The main plate 111 extends horizontally in use substantially equidistantly in opposite directions from the mixing tube 103. Fixedly secured to the bottom of the main plate 111 is a discharge channel plate 112, which is generally channel-shaped in transverse cross section and is provided with a pair of laterally outwardly extending attachment flanges 113 which are fixedly secured to the main plate 111.

A pair of impeller vanes 114 are respectively disposed adjacent to the opposite ends of the main plate 111 and project upwardly therefrom, the vanes 114 being respectively provided with attachment flanges 115, which are fixedly secured together with the main plate 111 and the attachment flanges 113 by suitable fasteners 116. While the impeller vanes 114 are illustrated as extending laterally inwardly over the main plate 111, it will be appreciated that they could also be reversed so that they extend laterally outwardly of the main plate 111.

Formed in the bottom of the discharge channel plate 112 adjacent to the center thereof are two spaced-apart, rectangular recirculation openings 117. Mounted within the discharge channel plate 112 and spanning the recirculation openings 117 is a diverter channel 118. Fixedly secured to the bottom of the discharge channel plate 112 between the recirculation openings 117 is the circular attachment plate 119 of an idler shaft 120, which extends vertically downwardly through a complementary opening in the baffle plate 27 and into a bearing 121 mounted thereon.

The operation of the mixing apparatus 20 will now be described in detail. Initially, the polymer feed assembly 40 is actuated by a control switch in the control box 33, but no dry polymer is fed to the eductor mixer assembly 60 until water is supplied thereto, as explained above. When the water supply is turned on, the water enters the annular chamber 86 through the water inlet channel 76, circulating in a counterclockwise direction around the annular chamber 86, as illustrated by the arrows in FIG. 3. This swirling stream of water then passes down through the nozzle opening 99 and is injected into the mixing region of the eductor mixer assembly 60 in a swirling hollow conical stream, as indicated by the arrows in FIG. 2. The conical shape of the nozzle opening 99 serves to increase the velocity of the swirling stream of water as it passes therethrough.

As the water is supplied to the eductor mixer assembly 60, it is also supplied to the air cylinder 52 of the feed control gate assembly 50, opening the gate 54 and permitting dry polymer to be fed from the feed conduit 43 into the inlet conduit 48. The dry polymer drops vertically into the eductor mixer assembly 60, as indicated by the broad arrow in FIG. 2, and falls through the vortex of the swirling conical stream of water, mixing therewith and being wetted thereby. The nozzle assembly 88, in addition to increasing the velocity of the swirling stream of water, also forms a Venturi which serves to pull the dry polymer downwardly into the swirling stream of water. This serves to eliminate the bridging problems common in many prior dry polymer mixing systems by preventing agglomeration at the exit end of the upper nozzle insert 90. It can be seen that the arrangement of the polymer feed assembly 40 and eductor mixer assembly 60 provides a minimum-length vertical path between the feed conduit 43 and the mixing region of the eductor mixer assembly 60, and minimizes the chance of blockage occurring in the dry polymer feed path.

A mixture of polymer and water exits the eductor mixer assembly 60 in a swirling stream which is injected into the mixing tube 103 of the rotating tube mixing assembly 100, being thrown against the side wall thereof. In an operative embodiment of the invention, the mixing tube 103 is rotated in the same direction as the direction of rotation of the stream of mixture exiting the eductor mixer assembly 60, although rotation in the opposite direction would also be possible. This rotation of the mixing tube 103 serves to provide additional mixing of the water with the polymer and also serves to urge the mixture against the wall of the mixing tube 103, providing a continuous washing effect on the inner surface of the mixing tube 103, thereby effectively preventing the clinging of polymer particles to the surface of the mixing tube 103 and resultant clogging.

As the swirling stream of mixture reaches the lower end of the mixing tube 103, it is urged by centrifugal force laterally outwardly in both directions along the channel formed between the main plate 111 and the discharge channel plate 112, in the direction of the arrows in FIG. 1. More particularly, the mixture exits the mixing tube 103 onto the diverter channel 118 and is then spun outwardly between the diverter channel 118 and the main plate 111, being discharged into the mixing compartment 31 of the housing 21 in a rotating spray.

The location of the impeller vanes 114 near the bottom of the mixing compartment 31 promotes vertical flow of the accumulated mixture within the compartment 31. The square cross section of the mixing compartment 31 has been found to provide a superior flow pattern which enhances mixing, as compared with tanks of circular cross section. As the impeller mixer assembly 110 rotates, the mixture reenters the discharge channel through the recirculation openings 117, to be further mixed with the incoming mixture. This serves to distribute the mixture of polymer and water immediately and evenly into the mixing compartment 31 with uniform mixing energy throughout the entire volume of the mixing compartment 31, regardless of the level of mixture therein.

The accumulated mixture in the mixing compartment 31 gradually migrates to the aging compartment 30 through the corner openings 28 in the baffle plate 27, being then directed downwardly along the trough-like bottom wall 23 to the outlet 26. This mixture is drawn up into the mixer and diluter 35 by a gear pump therein for further dilution.

It can be seen from the foregoing discussion that the mixing apparatus 20 provides essentially three different stages of mixing, viz., an initial mixing in the eductor mixer assembly 60, a secondary mixing in the rotating tube mixing assembly 100 and a third mixing effected by the impeller mixer assembly 110. Another significant aspect of the invention is that all of the diluting water for these three mixing stages is introduced in the first mixing stage in the eductor mixer assembly 60 to assure the most thorough and fastest dispersal of the polymer in this stage.

An important feature of the invention is that it achieves a mixture of maximum polymer strength in the aging compartment 30. Most existing systems are designed to produce a mixture containing about 0.5% by weight of polymer in the aging tank. With the present invention it is possible to provide a polymer strength of about 2.0% in the aging compartment 30, thereby effectively making the capacity of the aging compartment 30 "bigger" for a given volume than prior systems. This is possible because additional dilution to the desired use strength can be achieved in the mixer and diluter 35.

From the foregoing, it can be seen that there has been provided an improved mixing apparatus which provides multiple stages of mixing to assure rapid and complete mixing of dry polymer with diluting water. This is achieved in a system which permits maximum mixture strength in the aging tank and which also provides control means for preventing the injection of dry polymer in the absence of a diluting water stream.

What is claimed is;

1. Apparatus for mixing dry particulate material and a liquid diluent, said apparatus comprising: mixing structure including first and second bodies, said first body including a first nozzle portion having a first frustoconical inner surface defining an opening through said first body and a frustoconical outer surface, said first body having a circular cavity therein surrounding said first nozzle portion, said second body including a second nozzle portion having a second frustoconical inner surface defining an opening through said second body, means interconnecting said first and second bodies in an assembled condition to form said mixing structure with said first and second inner frustoconical surfaces cooperating to define a first path extending through said mixing structure and converging toward an exit end thereof, said second body cooperating with said cavity to define an annular chamber encircling said nozzle portions, said outer frustoconical surface being spaced from said second inner frustoconical surface for cooperation therewith to define an annular nozzle opening providing communication between said chamber and said first path, means for feeding particulate material to said first path, means for feeding liquid diluent into said chamber along a second path substantially tangent thereto for establishing a swirling flow of liquid around said nozzle portions and into said nozzle opening thereby to direct into said first path a hollow, swirling, frustoconical stream of liquid diluent, said stream of liquid diluent wetting and mixing with the particulate material and cooperating with said first frustoconical inner surface for forming a Venturi to draw particulate material into said first path, and secondary mixing means communicating with said first path for receiving the mixture of particulate material and liquid diluent therefrom and effecting further mixing thereof.

2. The apparatus of claim 1, wherein said second nozzle portion has a third frustoconical inner surface continuous with said second frustoconical inner surface and cooperating with said first frustoconical inner surface for defining said first path.

3. The apparatus of claim 1, and further including seal means disposed between said first and second bodies for providing a fluid-tight seal around said chamber.

4. The apparatus of claim 1, wherein said first path is disposed substantially vertically.

5. The apparatus of claim 1, and further including feed control means coupled to said means for feeding particulate material for preventing the feeding of particulate material in the absence of said stream of liquid diluent.

6. The apparatus of claim 1, wherein each of said first and second bodies has a recess therein, said first and second nozzle portions respectively comprising members respectively receivable in said recesses.

* * * * *